US005340104A

United States Patent [19]

Griffin

[11] Patent Number: 5,340,104

[45] Date of Patent: Aug. 23, 1994

[54] GOLF PUTTER HEAD WITH ADJUSTABLE HOSEL

[76] Inventor: Ronald D. Griffin, 1413 Agnes, Richland, Wash. 99352

[21] Appl. No.: 89,886

[22] Filed: Jul. 8, 1993

[51] Int. Cl.[5] ..... A63B 53/02

[52] U.S. Cl. ..... 273/80.2; 273/80 C; 273/167 G; 273/169; 403/359

[58] Field of Search ..... 273/80.1, 80.2, 79, 273/80 C, 167 G, 167 F, 169; 403/101, 102, 359

[56] References Cited

U.S. PATENT DOCUMENTS

| | | | |
|---|---|---|---|
| 1,352,020 | 9/1920 | Olson | 273/79 |
| 1,599,336 | 9/1926 | Lindgren | 273/80.1 |
| 1,657,972 | 1/1928 | Rowe | 273/79 |
| 2,155,830 | 4/1939 | Howard | 273/79 |
| 2,661,952 | 12/1953 | Jackson | 273/168 X |
| 3,462,155 | 8/1969 | Pelz . | |
| 3,989,257 | 11/1976 | Barr . | |
| 4,138,117 | 2/1979 | Dalton . | |
| 4,688,798 | 8/1987 | Pelz . | |
| 4,702,477 | 10/1987 | Solomon | 273/80 C |
| 4,722,528 | 2/1988 | Tsao | 273/80.2 X |
| 4,815,740 | 3/1989 | Williams | 273/80.1 |
| 4,852,880 | 8/1989 | Kobayashi | 273/169 |
| 5,080,365 | 1/1992 | Winchell . | |

FOREIGN PATENT DOCUMENTS

| | | | |
|---|---|---|---|
| 1222263 | 5/1987 | Canada | 273/80.1 |

*Primary Examiner*—Theatrice Brown
*Assistant Examiner*—Sebastiano Passaniti
*Attorney, Agent, or Firm*—Wells, St. John, Roberts, Gregory & Matkin

[57] ABSTRACT

An adjustable golf putter head assembly is described including a putter head and an adjustable hosel for connecting the head to a putter shaft. The putter head includes a forward ball striking surface formed substantially along a ball striking plane, a bottom sole surface, and a rearwardly facing back surface. The putter head further includes opposed toe and heel ends between which said forward ball striking surface, bottom sole surface and back surface extend. The hosel is of a goose neck configuration, and includes a first end for attachment to the putter head, and a second end for attachment to a club shaft. A pivot connection on the putter head back surface and the first end of the hosel interconnects the hosel and putter head at a location on the putter head substantially midway between the toe and heel ends, for selective pivot adjustment of the hosel relative to the putter head about a first axis substantially normal to the ball striking plane. An interlock component such as an epoxy adhesive joins the first end of the hosel and putter head within the pivot connection to affix the putter head and hosel together after initial adjustment in a selected angular relationship about the axis. The club head is substantially symmetrical to facilitate constant balance and afford adjustment for left or right handed golfers.

11 Claims, 3 Drawing Sheets

GOLF PUTTER HEAD WITH ADJUSTABLE HOSEL

TECHNICAL FIELD

The present invention relates to adjustable heads for golf club heads, preferably golf putters.

BACKGROUND OF THE INVENTION

The angle that a golf putter shaft makes with the putting surface has an effect on the golfer's stance, particularly the distance that must be maintained between the ball and the golfer's body.

For example, a putter with its shaft axis perpendicular to the putting green will allow the golfer to stand very close to the ball, while a shaft angle at, say 7° from vertical allows the golfer to stand further from the ball. The shape of the putter head's bottom surface will allow some variation, but not without sacrificing the ideal position of the head mass with respect to the ball.

A need has thus been realized for a putter with a head arrangement that can be adjusted to change shaft angle, yet remain balanced regardless of the angular relationship of the putter head to the shaft.

It also is desirable, for manufacturers, to be able to produce a single putter head that can be easily adapted to suit right or left handed golfers.

The present invention provides a solution to the above problems by providing adjustment capability, allowing the golfer to selectively set the shaft angle without upsetting the balance of the club head. The present invention also provides such adjustment features for either right or left handed golfers.

BRIEF DESCRIPTION OF THE DRAWINGS

A preferred embodiment of the invention is exemplified herein with reference to the accompanying drawings, which are briefly described below.

DETAILED DESCRIPTION OF THE PREFERRED EMBODIMENTS

Figure 1:
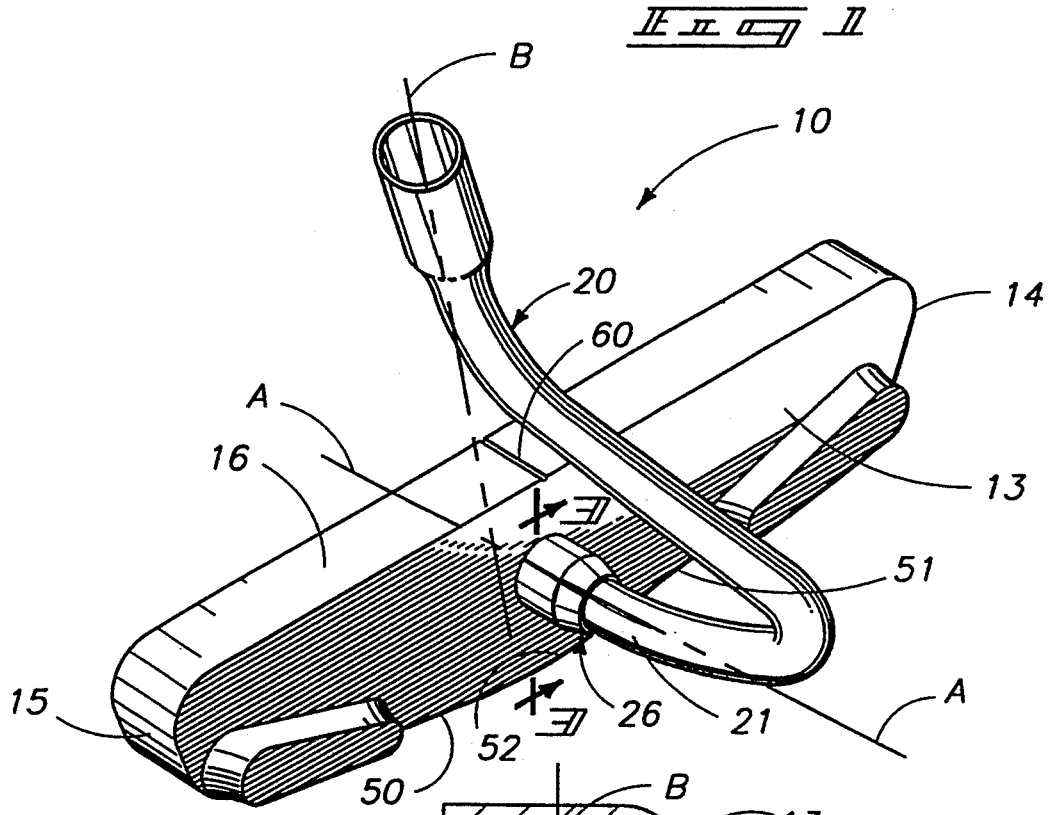
FIG. 1 is a rear perspective view of a first preferred form of the present invention.

This disclosure of the invention is submitted in furtherance of the constitutional purposes of the U.S. Patent Laws "to promote the progress of science and useful arts" (Article 1, Section 8).

A preferred example of the present adjustable golf putter head assembly is shown in the drawings, and is generally designated therein by the reference numeral 10. The assembly is comprised of two parts, a club head 9 and a hosel section 20.

The preferred putter head 9 includes a forward ball striking surface 11 formed substantially along a ball striking plane X. It also includes a bottom sole surface 12, and a rearwardly facing back surface 13. The putter head further includes opposed toe and heel ends 14, 15 respectively, between which said forward ball striking surface 11, a planar top surface 16, bottom sole surface 12 and back surface 13 extend.

Figure 6:
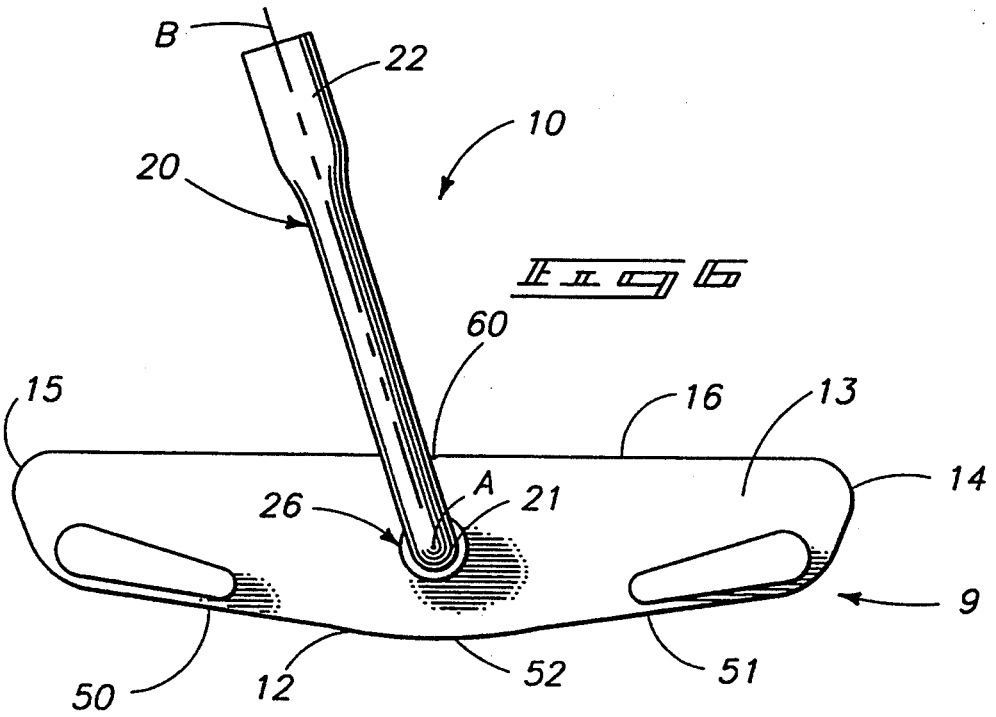
FIG. 6 is a back side elevation view of the assembled putter head and hosel adjusted for a right handed golfer.
Figure 7:
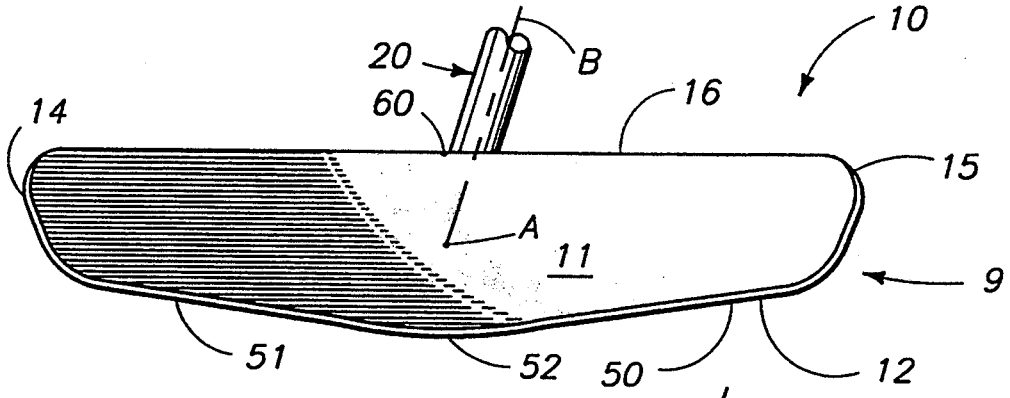
FIG. 7 is a front side elevation.
Figure 8:
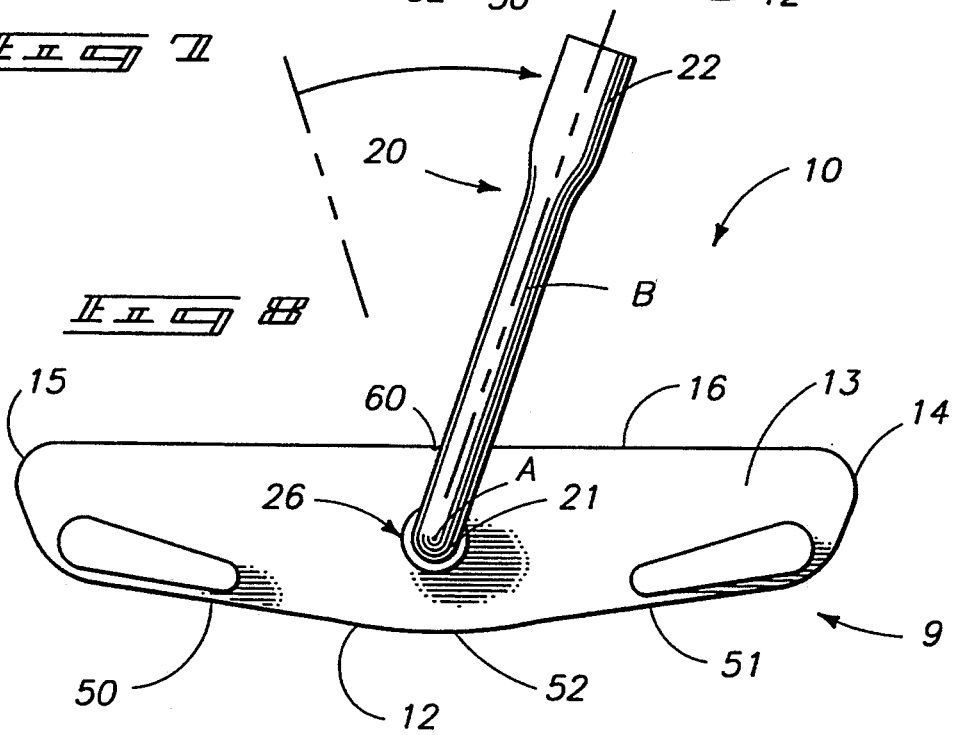
FIG. 8 is a back side elevation view of the assembled putter head and hosel adjusted for a left handed golfer.

The preferred bottom sole surface includes oppositely inclined surface sections 50, 51 leading from a central sole section 52 upwardly toward the respective toe and heel ends 14, 15. The surface sections 50, 51 are preferably equiangular with respect to the putter head top surface 16 to accommodate left or right handed golfers (compare FIGS. 6 and 8). In fact, the entire putter head 9 is substantially symmetrical about the central axis A to assure balance and ability to adjust equally to right and left handed golfers.

A sight groove 60 is provided along the top surface 16, parallel to the first axis A, indicating a preferred swing direction to the golfer, and locating the center of balance or "sweet spot" along the ball striking surface 11.

Figure 2:
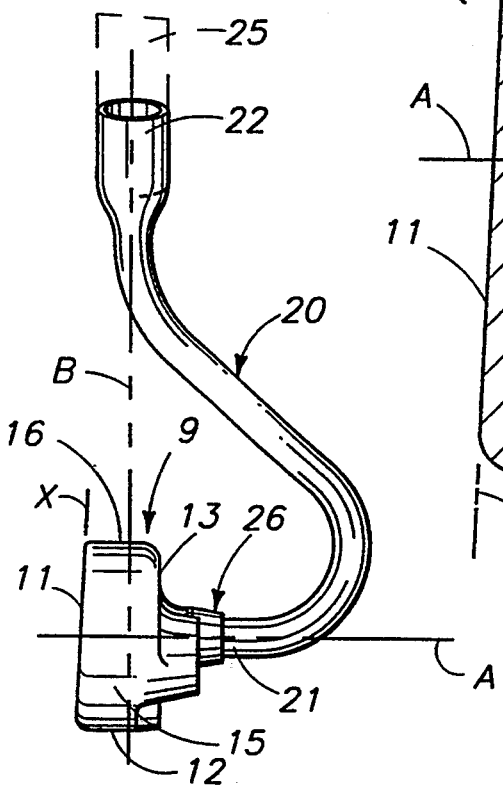
FIG. 2 is a side view of the present adjustable head.
Figure 3:
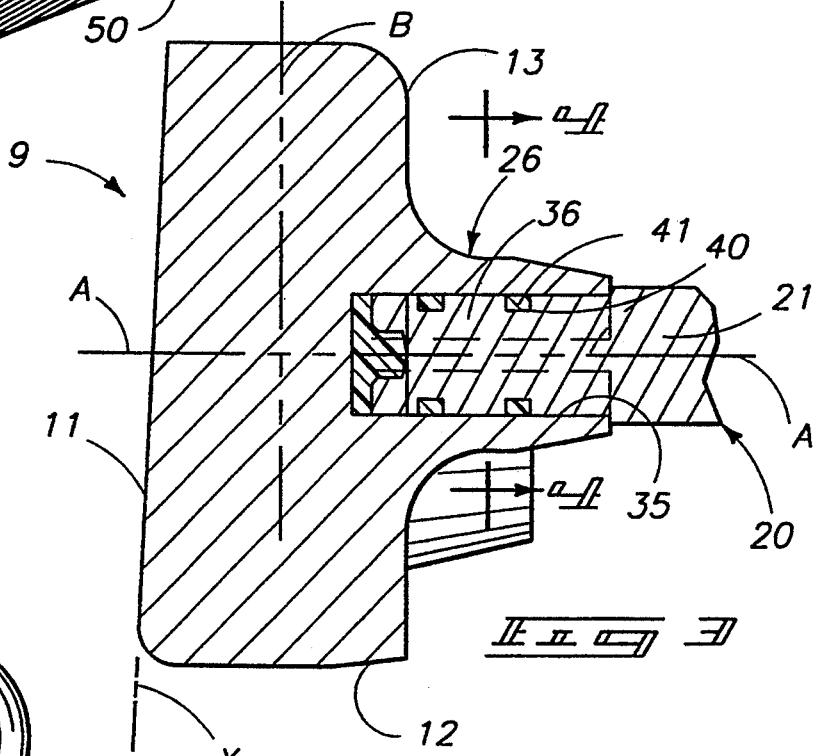
FIG. 3 is an enlarged sectional view taken along line 3—3 in FIG. 1.
Figure 4:
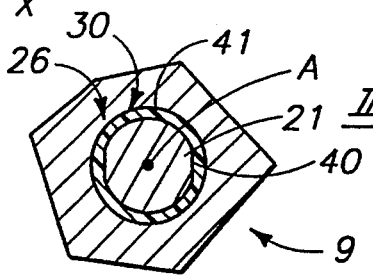
FIG. 4 is a sectional view taken along ling 4—4 in FIG. 3.
Figure 5:
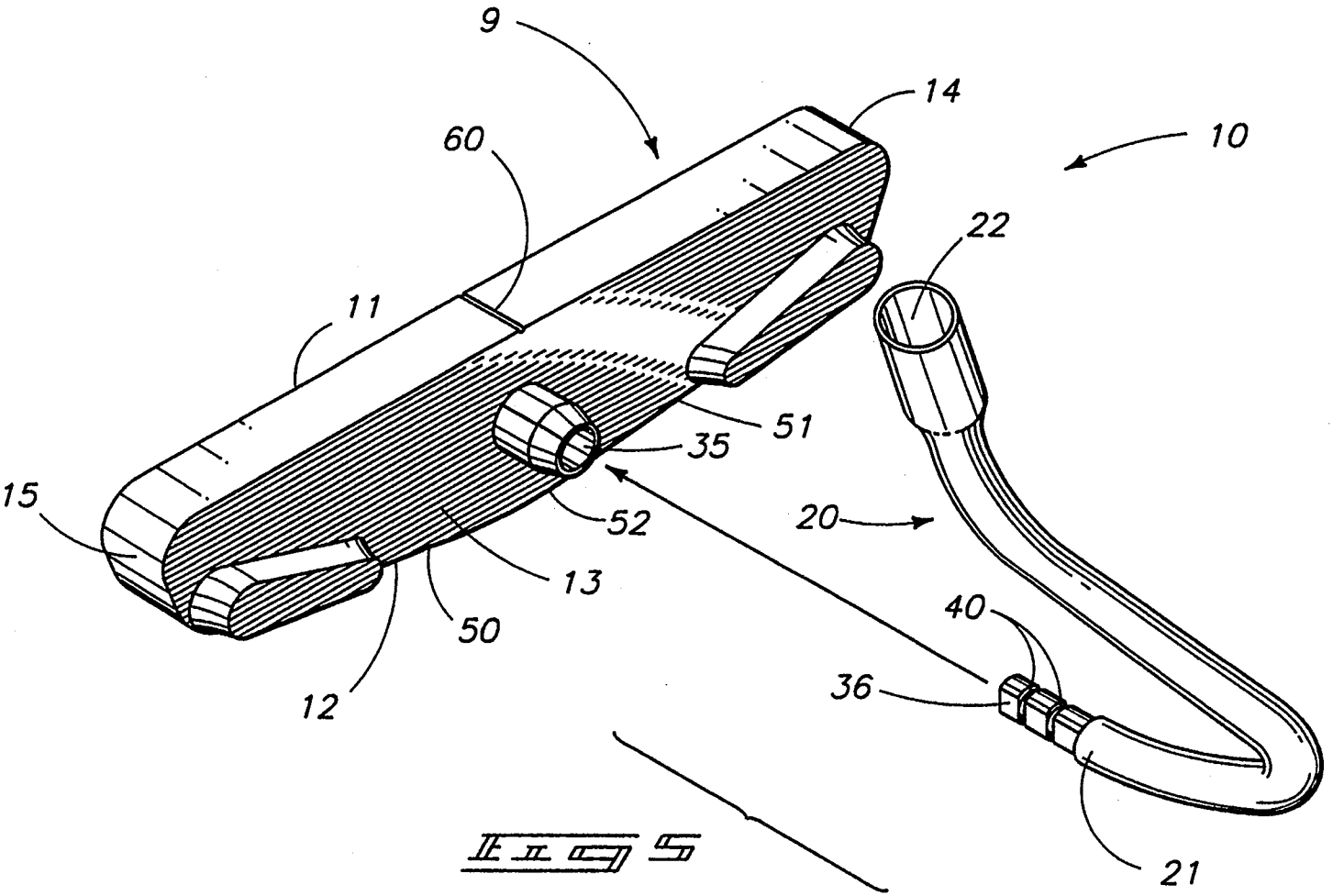
FIG. 5 is an exploded perspective view showing the assembly of the present putter head and hosel.

The hosel 20 is preferably formed in the goose neck configuration shown most accurately in FIG. 2. It includes a first end 21 for attachment to the putter head 9, and a second end 22 for attachment to a club shaft 25. It is noted that only part of the shaft 25 is shown, as it should be understood that many different forms of shaft may be used in conjunction with the present assembly.

The second end 22 defines a shaft axis B that, when assembled as shown in FIGS. 1–4, and 6–8 intersects the putter head forward of the back surface thereof.

Advantageously, the shaft axis B intersects the first axis A at the center of mass for the putter head 9. This assures a consistent balance in the putter assembly regardless of the angular position of the hosel about the axis A.

A pivot connection 26 is provided on the putter head back surface and the first end 21 of the hosel 20. Connection 26 interconnects the hosel 20 and putter head 9 at a location on the putter head substantially midway between the respective toe and heel ends 14, 15. The connection 26 enables selective pivot adjustment of the hosel 20 relative to the putter head 9 about a first axis A substantially normal to the ball striking plane X.

The preferred pivot connection 26 includes a mortise 35 (FIG. 3) formed in the putter head 9 along the back surface 13 thereof. The preferred connection 26 also includes a tenon 36 formed at the first end 21 of the hosel 20. In other alternate configurations, it is conceivable that the mortise and tenon could be reversed, with the mortise formed in the hosel, and the tenon on the club head 9.

The mortise 35 and tenon 36 are substantially cylindrical along the first axis to allow relative pivotal angular adjustment of the head and hosel about the axis A. This facilitates setting the angular relation of the hosel 20 and attached shaft 25 in a plane at a constant angle to the ball striking surface 11. Such adjustment is also afforded to left or right handed golfers, as exemplified in FIGS. 6 and 8.

An interlock component 30 is provided to join the first end of the hosel and putter head within the pivot connection 26, to affix the putter head 9 and hosel 20 together in a selected angular relationship about said axis A.

Adhesive flow and interlock channels 40 are formed in the tenon 36 to receive an adhesive 41. The adhesive is advantageously a conventional hard setting flowable epoxy material.

In final assembly, (preferably accomplished by the golfer or a golf equipment technician with the golfer in attendance) the adhesive is placed in its flowable state within the mortise 35. The tenon 36 is then inserted. The adhesive will flow around the tenon 36 and into the interlock channels 40. The desired angular relationship of the hosel 20 and putter head 9 is then set, and the adhesive is left to harden. This leaves the head 9 and hosel in a substantially permanent desired angular relationship, selected to suit the needs of the individual golfer, whether left or right handed.

It is noted that the balance of the putter head assembly is constant at whatever angular relation is selected between head 9 and hosel 20, due to the relationship of the axes A and B. The golfer thus does not have to sacrifice balance of the club to obtain a desired club head—shaft angular relationship.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An adjustable golf putter head assembly, comprising:

a putter head including a forward ball striking surface formed substantially along a ball striking plane, a bottom sole surface, and a rearwardly facing back surface;

wherein the putter head further includes opposed toe and heel ends between which said forward ball striking surface, bottom sole surface and back surface extend;

a hosel including a first end for attachment to the putter head, and a second end for attachment to a club shaft;

a pivot connection including a substantially cylindrical mortise and tenon on the putter head back surface and the first end of the hosel interconnecting the hosel and putter head at a location on the putter head substantially midway between the toe and heel ends, for selective pivot adjustment of the hosel relative to the putter head about a first axis substantially normal to the ball striking plane; and an interlock component joining the first end of the hosel and putter head at the pivot connection to affix the putter head and hosel together in a selected angular relationship about said first axis.

2. An adjustable golf putter head assembly, as defined by claim 1 wherein the hosel is goose neck shaped, with the second end defining a shaft axis intersecting the putter head forward of the back surface thereof.

3. An adjustable golf putter head assembly, as defined by claim 1 wherein the hosel is goose neck shaped, with the second end defining a shaft axis intersecting the first axis forward of the back surface of the putter head.

4. An adjustable golf putter head assembly, as defined by claim 1 wherein the pivot connection includes a mortise formed in the putter head along the back surface thereof and a tenon formed at the first end of the hosel, said mortise and tenon being substantially cylindrical along the first axis.

5. An adjustable golf putter head assembly, as defined by claim 1 wherein the pivot connection includes a mortise formed in the putter head along the back surface thereof and a tenon formed at the first end of the hosel, said mortise and tenon being substantially cylindrical along the first axis; and wherein the interlock component is comprised of an adhesive received between the mortise and tenon.

6. An adjustable golf putter head assembly, as defined by claim 1 wherein the pivot connection includes a mortise formed in the putter head along the back surface thereof and a tenon formed at the first end of the hosel, said mortise and tenon being substantially cylindrical along the first axis;

and further comprising adhesive flow and interlock channels formed in the tenon;

wherein the interlock component is comprised of an adhesive received between the mortise and tenon and within the interlock channels.

7. An adjustable golf putter head assembly, as defined by claim 1, wherein the bottom sole surface includes oppositely inclined surfaces leading from a central sole section upwardly toward the heel and toe ends.

8. An adjustable golf putter head assembly, as defined by claim 1, wherein the bottom sole surface includes oppositely inclined surfaces leading from a central sole section located below the axis and leading upwardly from the central sole section toward the heel and toe ends; and wherein the hosel is goose neck shaped, with the second end defining a shaft axis intersecting the club head adjacent the central sole section.

9. An adjustable golf putter head assembly, as defined by claim 1 comprising:

wherein the bottom sole surface includes oppositely inclined surfaces leading from a central sole section located below the axis and leading upwardly from the central sole section toward the heel and toe ends;

wherein the hosel is goose neck shaped, with the second end defining a shaft axis intersecting the central sole section forward of the back surface thereof; and the pivot connection includes a mortise formed in the putter head along the back surface thereof and a tenon formed at the first end of the hosel, said mortise and tenon being substantially cylindrical along the first axis.

10. An adjustable golf putter head assembly, as defined by claim 1:

wherein the bottom sole surface includes oppositely inclined surfaces leading from a central sole section located below the axis and leading upwardly from the central sole section toward the heel and toe ends;

wherein the hosel is goose neck shaped, with the second end defining a shaft axis intersecting the central sole section forward of the back surface thereof;

wherein the interlock component includes a mortise formed in the putter head along the back surface thereof and a tenon formed at the first end of the hosel, said mortise and tenon being substantially cylindrical along the first axis; and wherein the interlock component is comprised of an adhesive received between the mortise and tenon.

11. An adjustable golf putter head assembly, as defined by claim 1:

wherein the bottom sole surface includes oppositely inclined surfaces leading from a central sole section located below the axis and leading upwardly from the central sole section toward the heel and toe ends;

wherein the hosel is goose neck shaped, with the second end defining a shaft axis intersecting the central sole section forward of the back surface thereof;

wherein the pivot connection includes a mortise formed in the putter head along the back surface thereof and a tenon formed at the first end of the hosel, said mortise and tenon being substantially cylindrical along the first axis;

and further comprising adhesive flow and interlock channels formed in the tenon; and wherein the interlock component is further comprised of an adhesive received between the mortise and tenon.

* * * * *